US009236210B2

(12) United States Patent
Godesa

(10) Patent No.: US 9,236,210 B2
(45) Date of Patent: Jan. 12, 2016

(54) ELECTRICAL SWITCH

(71) Applicant: Ludvik Godesa, Berlin (DE)

(72) Inventor: Ludvik Godesa, Berlin (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 448 days.

(21) Appl. No.: 13/671,937

(22) Filed: Nov. 8, 2012

(65) Prior Publication Data

US 2013/0153382 A1 Jun. 20, 2013

(30) Foreign Application Priority Data

Dec. 14, 2011 (DE) ..... 10 2011 088 501

(51) Int. Cl.
*H01H 25/00* (2006.01)
*H01H 71/50* (2006.01)
*H01H 71/52* (2006.01)

(52) U.S. Cl.
CPC ..... *H01H 71/505* (2013.01); *H01H 71/526* (2013.01)

(58) Field of Classification Search
CPC ..... H01H 75/00; H01H 77/00; H01H 73/00; H01H 3/00; H01H 69/00; H01H 71/00; H01H 71/02; H01H 71/025; H01H 71/10; H01H 71/50; H01H 71/52; H01H 71/521–71/528; H01H 71/56; H01H 2003/00; H01H 2003/02; H01H 2003/022
USPC ..... 200/337
See application file for complete search history.

(56) References Cited

U.S. PATENT DOCUMENTS

| | | | | |
|---|---|---|---|---|
| 5,334,808 | A | 8/1994 | Bur et al. | |
| 5,449,871 | A * | 9/1995 | Batteux et al. | 200/401 |
| 2002/0153238 | A1 | 10/2002 | Baldauf et al. | |

FOREIGN PATENT DOCUMENTS

| | | |
|---|---|---|
| AT | 246835 | 5/1966 |
| CH | 385 975 | 12/1964 |
| CN | 1077818 A | 10/1993 |
| CN | 1558438 A | 12/2004 |

(Continued)

OTHER PUBLICATIONS

Kommunikationsfähige Leistungsschalter SENTRON WL und SENTRON VL. Systemhandbuch, http://cache.automation.siemens.com/dnl_lis/Tc/Tc2MDI5AAAA_39850157_HB/circuit_breakers_comm_capabilities_WL_VL_modbus_de-De.pdf(online); Others; 2011; DE.

(Continued)

*Primary Examiner* — Edwin A. Leon
*Assistant Examiner* — Anthony R. Jimenez
(74) *Attorney, Agent, or Firm* — Harness, Dickey & Pierce, P.L.C.

(57) ABSTRACT

An electrical switch is disclosed and includes a tensioning lever which, in the switched-on state of the switch, assumes a tensioning lever position tensioned by spring tension, and a locking device which can lock the tensioning lever into the tensioned tensioning lever position. In accordance with an embodiment of the invention, the locking device includes a rocker lever, which is attached rotatably to the tensioning lever around a rotary bearing, and a pawl, pivotable around a pivot point, which rests in the locked state on the rocker lever and in this way prevents the pivoting of the tensioning lever and—after an unlocking of the locking device—pivots away from the rocker lever and, in doing so, turns or can at least turn the rocker lever.

14 Claims, 6 Drawing Sheets

(56) References Cited

FOREIGN PATENT DOCUMENTS

| | | | |
|---|---|---|---|
| DE | 2008086 | | 10/1970 |
| DE | 2649038 | | 5/1977 |
| EP | 0587415 | A1 | 10/1993 |
| EP | 1130614 | A1 | 9/2001 |

OTHER PUBLICATIONS

SENTRON 3VL http://cache.automation.siemens.com/(online); Others; 2008.

Office Action for German patent application No. 10 2011 088 501.3 dated Sep. 14, 2012.

Chinese Office Action dated Aug. 3.2015, for Chinese Patent Application No. 201210540931 (with English translation).

* cited by examiner

ELECTRICAL SWITCH

PRIORITY STATEMENT

The present application hereby claims priority under 35 U.S.C. §119 to German patent application number DE 10 2011 088 501.3 filed Dec. 14, 2011, the entire contents of which are hereby incorporated herein by reference.

FIELD

At least one embodiment of the invention generally relates to an electrical switch.

BACKGROUND

A switch is marketed by Siemens AG under the product name Sentron 3VL for example. This electrical switch has a tensioning lever which, in the on state of the switch, assumes a tensioning lever position tensioned by spring tension. A locking device is also present which can lock the tensioning lever in the tensioned tensioning lever position.

SUMMARY

A switch is specified in which, even in the event of wear in the locking device, reliable unlocking of the locking device is still guaranteed.

Advantageous embodiments of the inventive switch are specified in the subclaims.

Accordingly there is provision, in accordance with an embodiment of the invention, for the locking device to comprise a rocker lever, which is fastened rotatably around a rotary bearing to the tensioning lever, and for the locking device to comprise a pawl able to be pivoted around a pivot point which, in the locked state, rests on the rocker lever and thereby prevents the pivoting of the tensioning lever and—after unlocking of the locking device—pivots away from the rocker lever and, when this occurs, turns or at least can turn the rocker lever around the rotary bearing.

An embodiment of the invention also relates to a locking device for an electrical switch as described above. In accordance with an embodiment of the invention there is provision in this regard for the locking device to comprise a rocker lever which is able to be attached around a rotary bearing rotatably to the tensioning lever and for the tensioning device to comprise a pawl able to be pivoted around a pivot point which, in the locked state, rests on the rocker lever and thereby prevents the tensioning lever from pivoting and—after unlocking of the locking device—pivots away from the rocker lever and, in doing so, turns the rocker lever around the rotary bearing or at least can turn the lever.

An embodiment of the invention also relates to a method for locking and unlocking a locking device of an electrical switch. Inventively there is provision with regard to such a method that, for locking the locking device, a pawl able to be pivoted around a pivot point is pivoted into a position in which the pawl rests on a rocker switch rotatable around a rotary bearing attached to a tensioning lever and thereby prevents the pivoting of the tensioning lever, and for unlocking the locking device, it is made possible for the pivotable pawl to pivot away from the rocker lever wherein, during the pivoting away of the pivotable pawl, the pivotable pawl turns the rocker lever around the rotary bearing attached to the tensioning lever.

BRIEF DESCRIPTION OF THE DRAWINGS

The invention will be explained below with reference to an example embodiment in which the figures show the following examples.

In the figures, for the sake of clarity, the same reference characters are always used for identical or comparable components.

DETAILED DESCRIPTION OF THE EXAMPLE EMBODIMENTS

Figure 1:
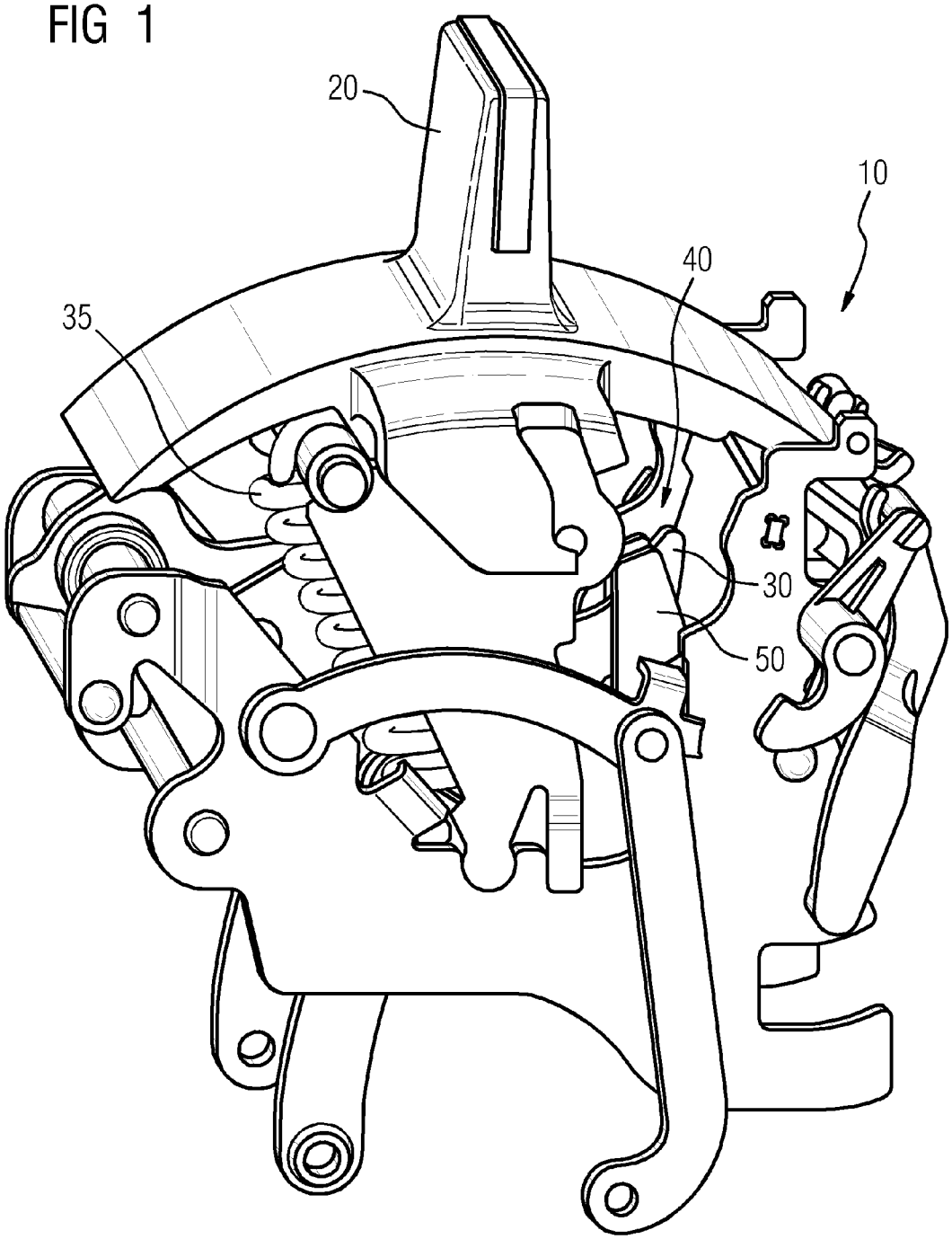
FIG. 1 shows an example embodiment for an inventive electrical switch with an example embodiment for a locking device in a three-dimensional view at an angle from above, wherein the switched-on and locked state of the switch is shown.

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

Accordingly there is provision, in accordance with an embodiment of the invention, for the locking device to comprise a rocker lever, which is fastened rotatably around a rotary bearing to the tensioning lever, and for the locking device to comprise a pawl able to be pivoted around a pivot point which, in the locked state, rests on the rocker lever and thereby prevents the pivoting of the tensioning lever and—after unlocking of the locking device—pivots away from the rocker lever and, when this occurs, turns or at least can turn the rocker lever around the rotary bearing.

A major advantage of an embodiment of the inventive switch is to be seen in the fact that easy and rapid unlocking of the locking device remains possible even in the event of wear to the surface of the rocker lever and/or the contact surface of the pawl resting thereon. Even if friction or a positive fit makes it impossible for the pawl to slide on the rocker lever, the pawl can pivot away from the rocker lever, because the rocker lever is rotatable on the tensioning lever and can be turned by the pawl, so that even if the point of contact between pawl and rocker lever is maintained (e.g. by a positive fit or adhesion friction) pivoting away of the pawl, unlocking of the locking device and release of the tensioning lever is still possible.

It is seen as especially advantageous for an imaginary straight line passing through the rotary bearing and the contact point at which the pivotable pawl rests on the rocker lever to be at a distance from the pivotable pawl, so that it exerts a torque on the pivotable pawl that wants to pivot the pivotable pawl away from the rocker lever. This torque allows an automatic pivoting away of the pawl to be guaranteed when the latter is no longer held by other parts of the switch in its position resting on the rocker lever.

The properties of the outer surface of the rocker lever can be such that the pivotable pawl is prevented by a positive fit or by adhesion friction from sliding on the outer surface and a rotational movement of the rocker lever around the rotary bearing is always brought about when the lock is released.

As regards latching of the pawl in its position resting on the rocker lever, it is seen as advantageous for the switch to have a tripping shaft, which—in the locked state of the locking device—rests with a stop on the pawl and prevents the pawl pivoting away from the rocker lever.

Preferably a pin is attached to the rocker lever which is guided in a guide motion link of the tensioning lever, wherein the tensioning lever limits the pivot angle of the rocker lever around the tensioning lever. The guide motion link is preferably formed by a hole or by a slot.

It is also seen as advantageous for the locking device to have a spring which rests with one end of the spring on the tripping shaft and with another end of the spring on the pawl and generates a torque which opposes the torque that the rocker lever exerts on the pawl. Such a spring can be used for example to bring the pawl into a defined position when the tensioning lever is tensioned.

The spring force of the spring is preferably dimensioned such that the torque generated by the spring is smaller than the torque generated by the rocker lever.

For operation the switch preferably has a switching lever which makes it possible for an operator to turn the switch on and off and is connected to the tensioning lever.

An embodiment of the invention also relates to a locking device for an electrical switch as described above. In accordance with an embodiment of the invention there is provision in this regard for the locking device to comprise a rocker lever which is able to be attached around a rotary bearing rotatably to the tensioning lever and for the tensioning device to comprise a pawl able to be pivoted around a pivot point which, in the locked state, rests on the rocker lever and thereby prevents the tensioning lever from pivoting and—after unlocking of the locking device—pivots away from the rocker lever and, in doing so, turns the rocker lever around the rotary bearing or at least can turn the lever.

As regards the advantages of an embodiment of the inventive locking device the reader is referred to the remarks given above in connection with the inventive switch, since the advantages of an embodiment of the inventive locking device correspond essentially to those of the inventive switch.

An embodiment of the invention also relates to a method for locking and unlocking a locking device of an electrical switch. Inventively there is provision with regard to such a method that, for locking the locking device, a pawl able to be pivoted around a pivot point is pivoted into a position in which the pawl rests on a rocker switch rotatable around a rotary bearing attached to a tensioning lever and thereby prevents the pivoting of the tensioning lever, and for unlocking the locking device, it is made possible for the pivotable pawl to pivot away from the rocker lever wherein, during the pivoting away of the pivotable pawl, the pivotable pawl turns the rocker lever around the rotary bearing attached to the tensioning lever.

As regards the advantages of an embodiment of the inventive method the reader is referred to the remarks given above in connection with the inventive switch, since the advantages of the inventive method correspond essentially to those of an embodiment of the inventive switch.

FIG. 1 shows elements of an example embodiment for an electrical switch 10, which can involve an electrical circuit breaker for example. In accordance with the diagram depicted in FIG. 1 the switch 10 is in its switched-on state, in which the switching mechanism is locked.

FIG. 1 shows a switching lever 20, which is connected to a tensioning lever 30. One of the forces exerted on the tensioning lever 30 is the spring force of a switching spring 35 which, in accordance with the diagram depicted in FIG. 1, wants to pivot the tensioning lever 30 upwards in the clockwise direction. Such a pivoting of the tensioning lever 30 is prevented with the switch 10 in the switched-on and locked state by a locking device 40, of which only a rocker lever 50 can readily be seen in the figure.

Figure 2:
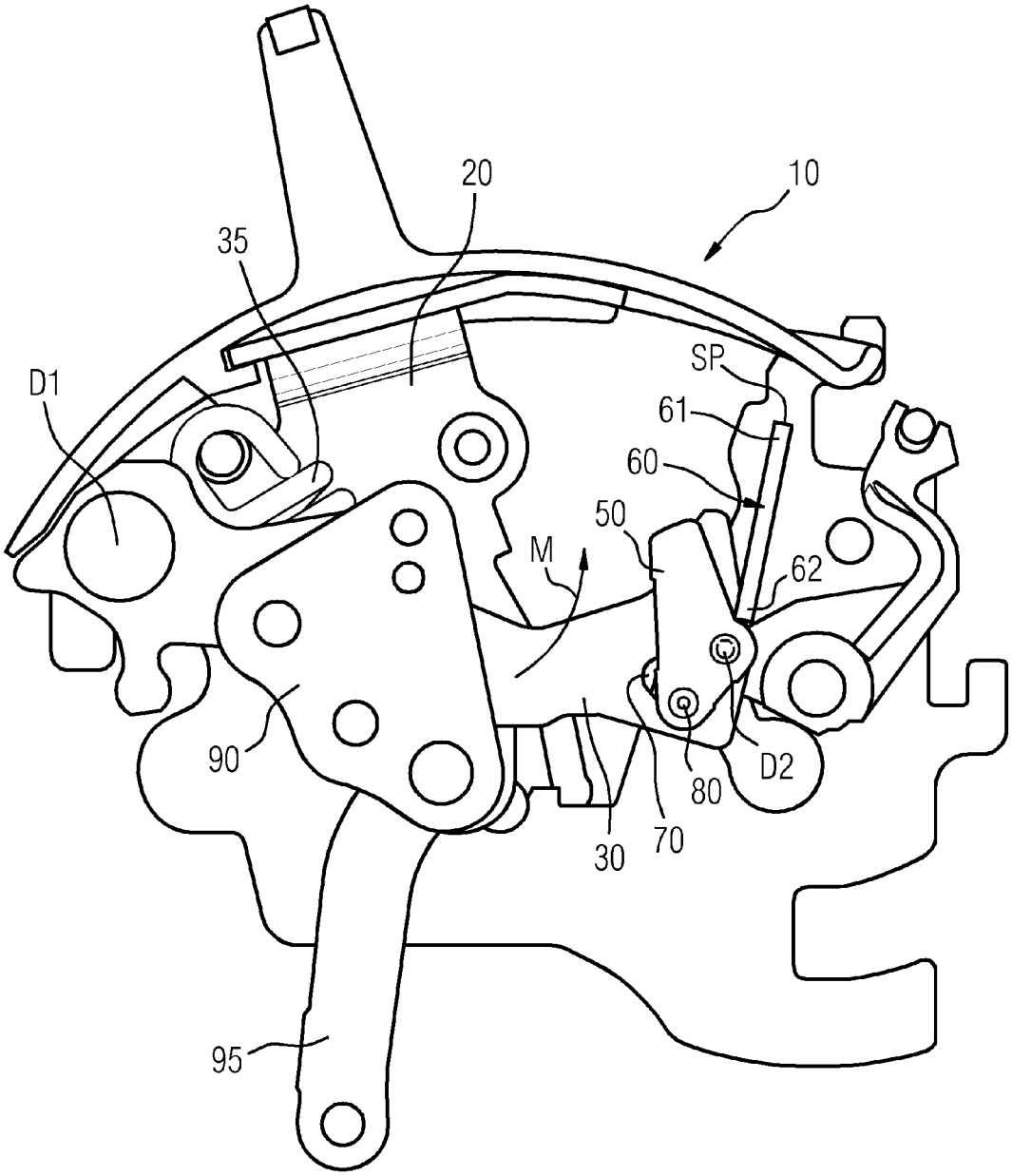
FIGS. 2-6 show different cross sections of the switch in accordance with FIG. 1, on the basis of which the method of operation of the locking device is explained in greater detail.

FIG. 2 shows the switch 10 in a cross section. It can be seen that the tensioning lever 30 is supported pivotably around a rotary bearing D1. The switching spring 35 causes a torque M that wishes to pivot the tensioning lever 30 upwards around the rotary bearing D1. The pivoting of the tensioning lever 30 is prevented by the locking device, which includes a pawl 60. An upper end 61 of the pawl 60 is held pivotably at a pivot point SP, so that the pawl 60 can pivot around this pivot point SP.

In the switched-on and locked state, a lower end 62 of the pawl 60 rests on the rocker lever 50.

FIG. 2 shows that the rocker lever 50 is attached by means of a rotary bearing D2 rotatably to the tensioning lever 30. The rotational or pivoting movement of the rocker lever 50 around the rotary bearing D2 is delimited by a slot 70 which is made in the tensioning lever 30. Guided in the slot 70 is a pin 80 which is permanently connected, for example riveted, to the rocker lever 50. If the rocker lever 50 is thus rotated around the rotary bearing D2, a rotation is only possible until such time as the pin 80 has reached the respective end of the slot 70.

FIG. 2 additionally shows further elements of the switch 10, namely an upper hinged lever 90 and also a lower coupling plate 95, which however do not have any role to play in the further explanations of the mode of operation.

Figure 3:
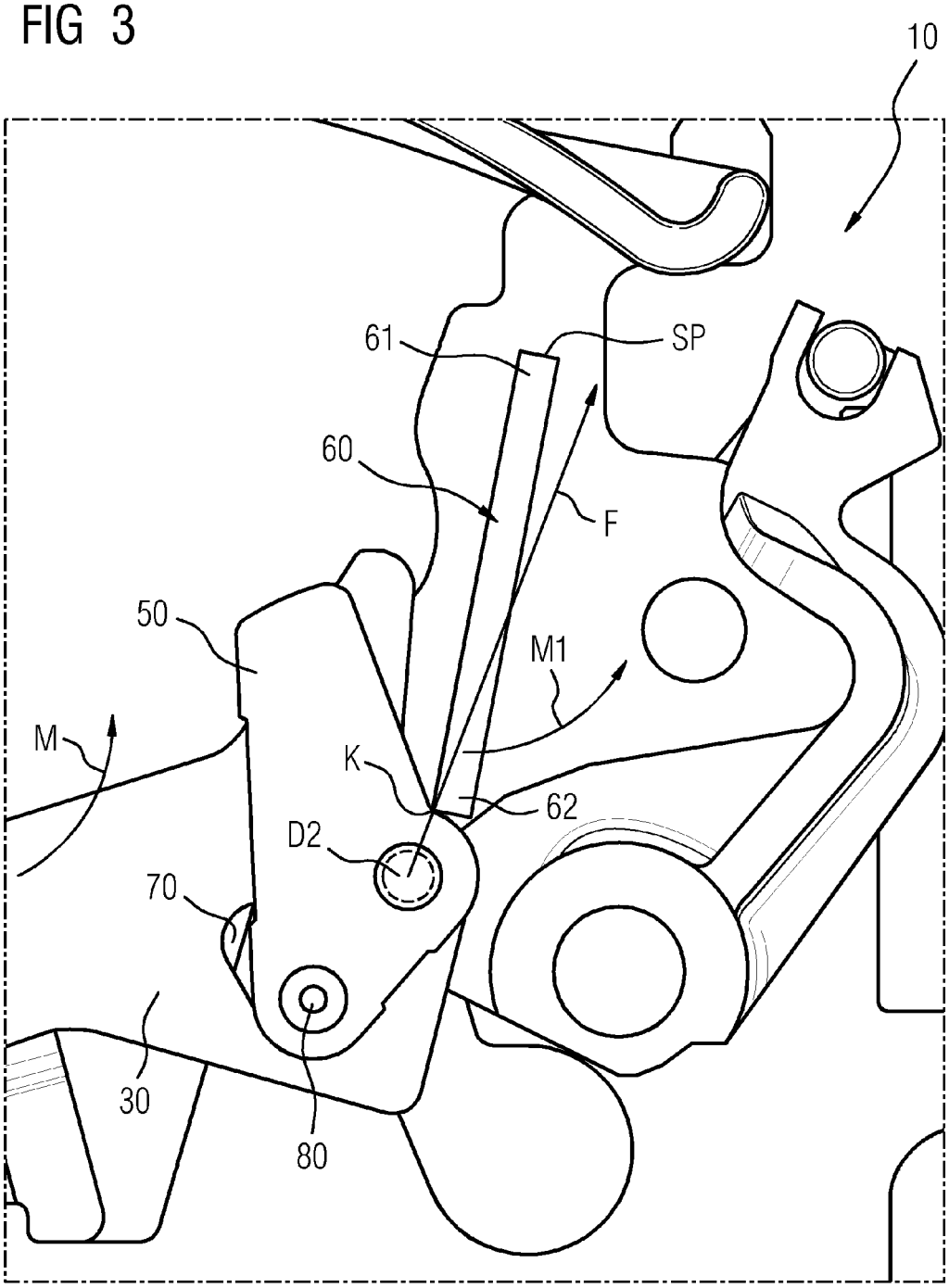

In FIG. 3 the locking device is shown in greater detail. The figure shows the pawl 60, the upper end 61 of which is attached pivotably to the pivot point SP. In addition it can readily be seen in FIG. 3 that the lower end 62 of the pawl is in contact at a contact point K on the rocker lever 50 and rests against the latter. As already mentioned, the rocker lever 50 can rotate around the rotary bearing D2 within the framework of the maximum pivot angle range defined by the pin 80 and the slot 70.

Since the torque M acts on the tensioning lever 30, which wants to pivot the tensioning lever 30 in FIG. 3 upwards, the rocker lever 50 exerts a torque M1 on the pawl 60. The torque M1 is generated by the rocker lever 50 because the force vector F, which extends along the connecting line between the rotary bearing D2 and the contact point K, is taken past the center of gravity SP.

In the diagram in accordance with FIG. 3, despite the torque M1, there is no pivoting of the pawl 60, since the pawl 60 is held by a stop of a tripping shaft of the switch not shown in FIG. 3.

Figure 4:
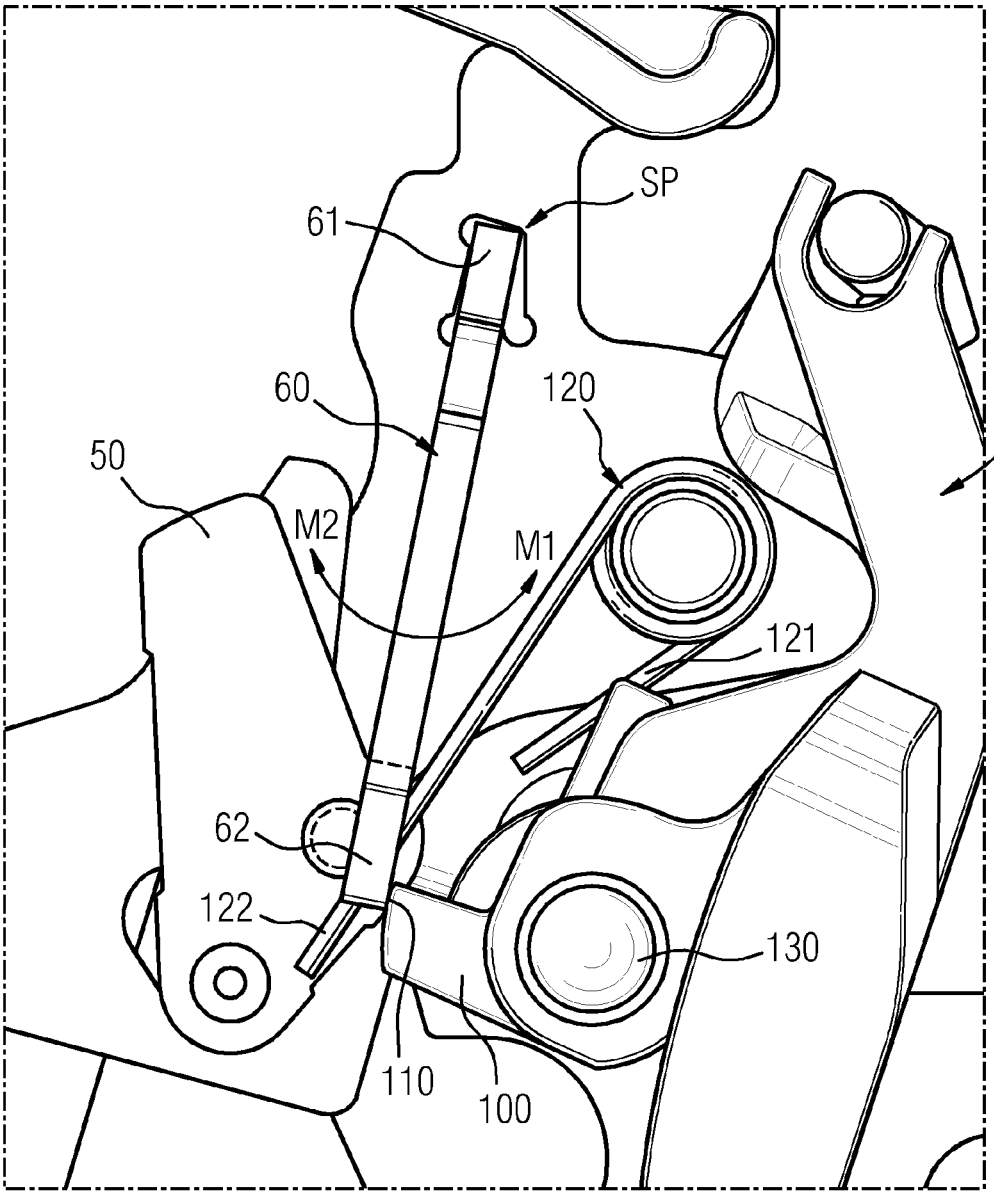

FIG. 4 shows the switch in another cross section which shows a tripping shaft 100 of the switch with its stop 110. It can be seen that in the switched-on and locked position of the switch 10, the stop 110 prevents the pawl 60 pivoting in the counterclockwise direction.

FIG. 4 also shows a spring 120, which rests at one end 121 on a mating part. The other spring end 122 rests against the pawl 60 and generates a torque M2, which wants to rotate the pawl 60 around the pivot point SP in the clockwise direction. The torque M2 that the spring 120 generates is thus in opposition to the torque M1 that the rocker lever 50 exerts on the pawl 60.

The spring force of the spring 120 is dimensioned such that the torque M2 is lower than the torque M1 that the rocker lever 50 exerts. Thus, were the stop 110 of the tripping shaft 100 not to rest against the lower pawl end 62 and prevent pivoting of the pawl 60, the pawl 60, because of the torque M1 would pivot in the counterclockwise direction around the pivot point SP, unlock the locking device and make it possible to switch off the switch lever of the switch.

If the switch is now to be switched off, the tripping shaft 100 must merely be pivoted around its axis of rotation 130 in the counterclockwise direction, so that the stop 110 can disengage from the lower pawl end 62 of the pawl 60. If the stop 110 is namely pivoted in the counterclockwise direction downwards, the rocker lever 50 with its torque M1 will pivot the pawl 60 so that the locking device can unlock and the switch can switch off.

Figure 5:
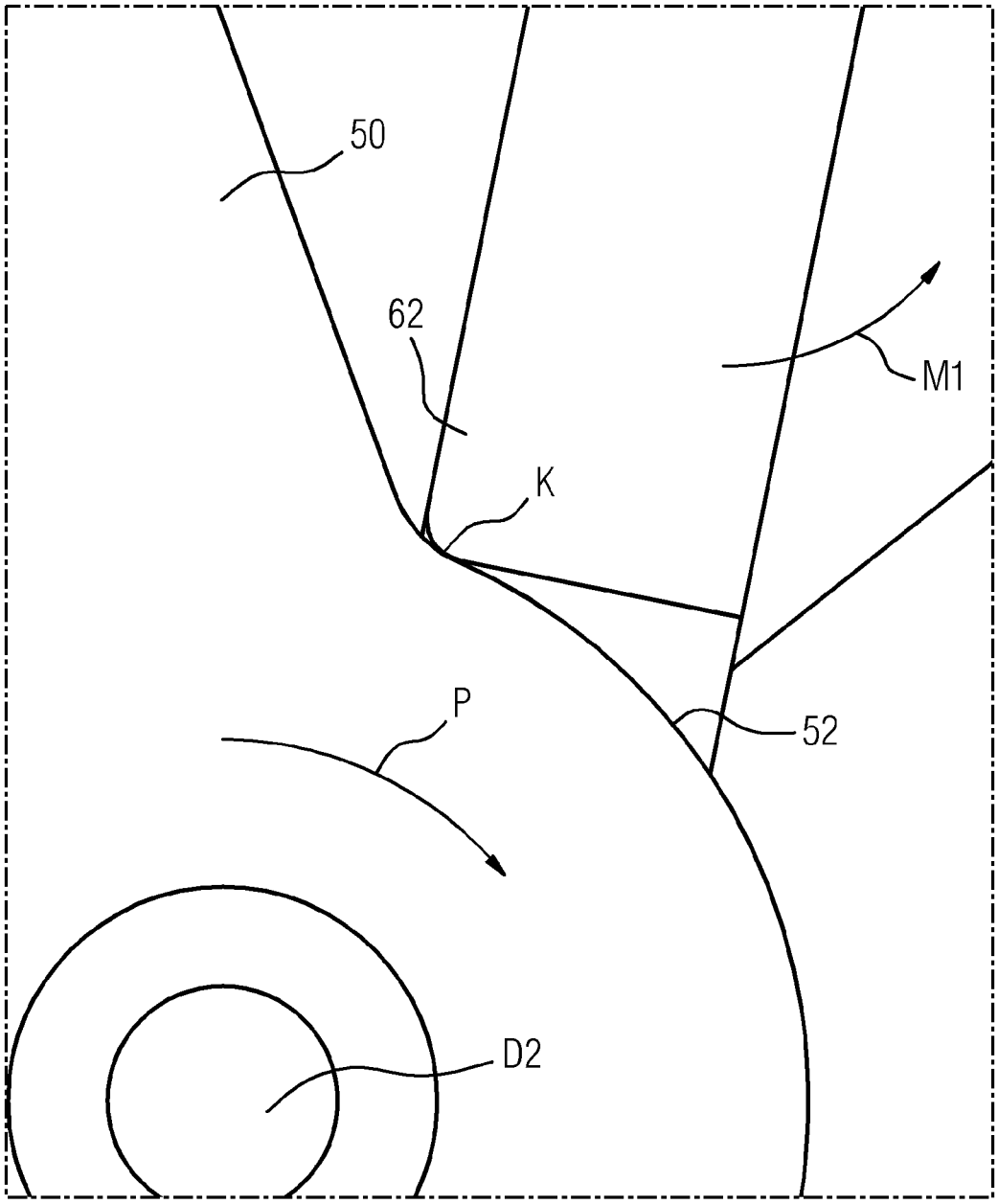

FIG. 5 shows in greater detail how the lower pawl end 62 rests on the outer surface 52 of the rocker lever 50. The contact point between the lower pawl end 62 and the outer surface 52 is identified by the reference character K.

If the stop 110 in accordance with FIG. 4 is pivoted downwards in FIG. 4 so that the pawl 60 is released, the torque M1 that the rocker lever 50 exerts on the pawl 60 will lead to a pivoting of the pawl 60 relative to the rocker lever 50. Depending on the embodiment of the outer surface 52, different situations can now occur:

Variant 1:

If the outer surface 52 is sufficiently smooth, the lower end of the pawl 62 can slide or glide on the outer surface 52 so that pivoting of the pawl 60 without the associated action of the rocker lever 50 or a twisting of the rocker lever 50 is possible. Unlocking the locking device would also occur by the contact point K sliding away on the outer surface 52.

Variant 2:

If the outer surface 52 is not sufficiently smooth however or if the friction is too great, for example as a result of wear in the switch 10 or to the outer surface 52, this can result in the lower end of the pawl 62 not being able to slide on the outer surface 52 and thus a relative movement can take place between the contact point K and the outer surface 52. In this case the result will still be a pivoting of the pawl 60 however since namely the rocker lever 50 is supported rotatably, preferably rotatably with little friction, around the rotary bearing D2. The torque M1 then leads to the pawl 60 being pivoted in the counterclockwise direction and, when this occurs, turning the rocker lever 50 clockwise in the direction of the arrow P. The contact point K between the lower pawl end 62 and the outer surface 52 is maintained unchanged in such cases since the lower pawl end 62 does not slide on the outer surface 52, but imparts a rotational movement to the outer surface 52 and thereby the rocker lever 50. Since the rocker lever 50 is rotatable within the constraints specified by the slot 70 and the pin 80 (cf. FIG. 2), the rocker lever 50 can thus move in the clockwise direction in the direction of the arrow P and thus make pivoting of the pawl 60 around the pivot point SP (cf. FIG. 3) possible.

Variant 2 thus results in pivoting of the pawl 60 because of the adhesion friction at contact point K and the rotation of the rocker lever 50 produced as a result of the torque M1.

Variant 3:

If the outer surface 52 makes a positive fit with the lower end of the pawl 62, so that the lower end of the pawl 62 is fixed on the outer surface 52, the lower end of the pawl 62 will turn the rocker lever 50, as has been explained in connection with variant 2. The tripping of the locking device thus takes place as a result of the turning away of the rocker lever 50.

Figure 6:
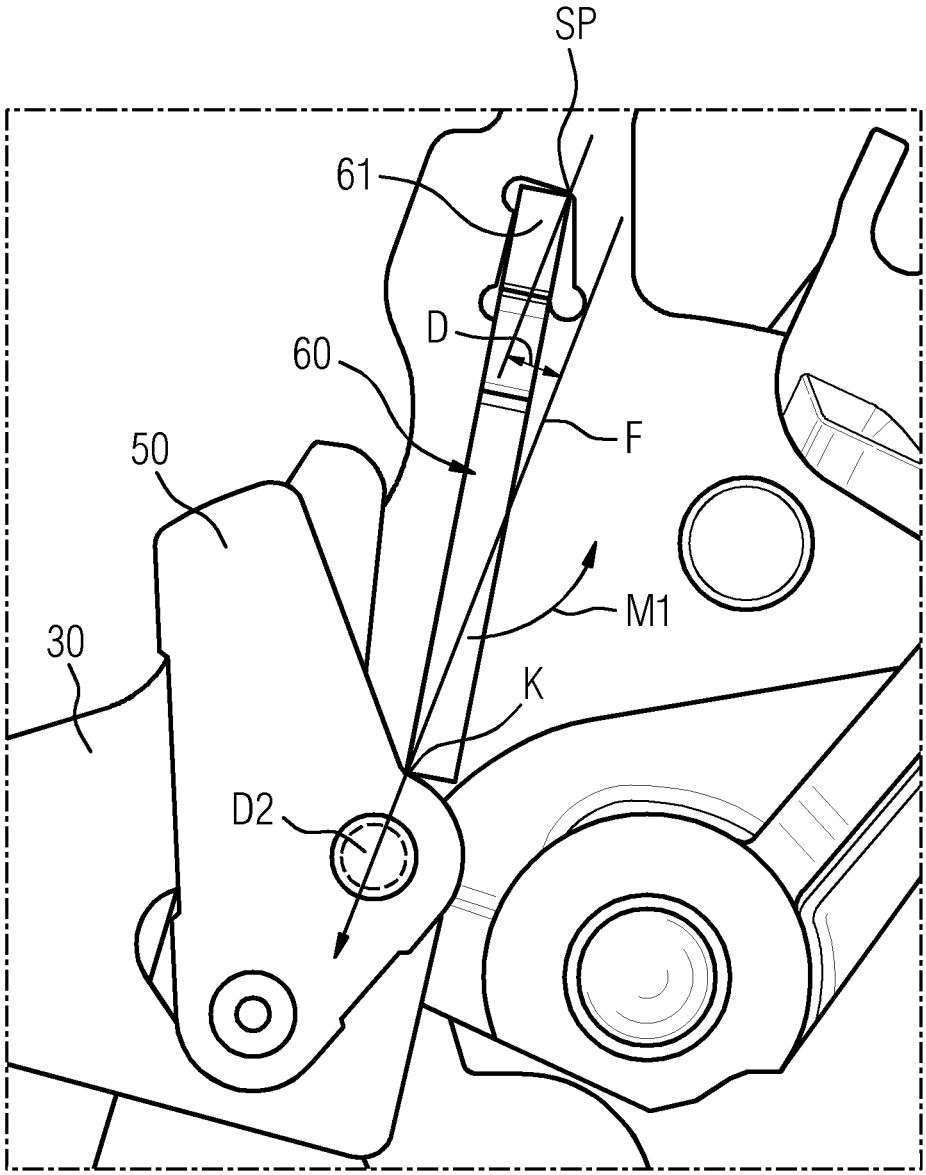

FIG. 6 shows the interaction between the pawl 60 and the rocker lever 50 once again in greater detail in a different diagram. It can be seen that the force vector F which the pawl 60 exerts on the rocker lever 50, is routed through the contact point K and the middle of the rotary bearing D2. The connecting line between the contact point K and the rotary bearing D2 is at a distance D from the center of gravity SP around which the pawl 60 is held rotatably.

Because of this distance D the rocker lever 50 or the outer surface of the rocker lever 50 can generate the torque M1 which pivots the pawl 60 after it has been tripped by the tripping shaft 100 (cf. FIG. 4) and unlocks the locking device 40. As soon as the pawl 60 is pivoted away, the tensioning lever 30 is no longer prevented by the pawl 60 from pivoting upwards in the counterclockwise direction in FIG. 6 and switching the switch off.

In summary the unlocking of the locking device is thus based on the interaction of the spring 120, the stop 110, the pawl 60 and the rocker lever 50 (cf. FIG. 4), wherein a secure and reliable unlocking of the locking device 40 is guaranteed by pivoting of the pawl 60 by sliding on the outer surface 52 of the rocker lever 50 and/or by turning the rocker lever 50 around the rotary bearing D2. Thus even if, as a result of wear in the outer surface 52, it is no longer possible for the pawl 60 to slide on the outer surface 52 and the pawl 60 can or would thus jam, secure unlocking is still guaranteed because namely, instead of a sliding, a rolling off of the rocker lever on the outer surface 52 of the rocker lever 50 takes place wherein, in this rolling off, the rocker lever 50 is pivoted around the rotary bearing D2 and the locking device 40 is unlocked.

Although the invention has been illustrated and described in greater detail by example embodiments, the invention is not restricted by the disclosed examples and other variations can be derived therefrom by the person skilled in the art without departing from the scope of protection of the invention.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE CHARACTERS

10 Switch
20 Switching lever
30 Tensioning lever
35 Switching spring
40 Locking device
50 Rocker lever
52 Outer surface
60 Pawl
61 Pawl end
62 Pawl end
70 Slot
80 Pin
90 Hinged lever
95 Coupling bar
100 Tripping shaft
110 Stop
120 Spring
121 Spring end
122 Spring end
130 Axis of rotation
D Distance
D1 Rotary bearing
D2 Rotary bearing
F Force vector
K Contact point
M Torque
M1 Torque
P Direction of arrow
SP Pivot point

What is claimed is:

1. An electrical switch, comprising:

a tensioning lever, configured to assume, in a switched-on state of the electrical switch, a tensioning lever position tensioned by spring tension; and a locking device, configured to lock the tensioning lever in the tensioned tensioning lever position, the locking device including a rocker lever, attached rotatably to the tensioning lever around a rotary bearing, and a pawl, pivotable around a pivot point on an uppermost edge of the pawl, configured to rest on the rocker lever and prevent the pivoting of the tensioning lever in the locked state and, configured to, after an unlocking of the locking device, pivot away from the rocker lever to turn the rocker lever around the rotary bearing.

2. The electrical switch of claim 1, wherein an imaginary straight line passing through the rotary bearing and a contact point, at which the pivotable pawl rests on the rocker lever, is at a distance from the pivot point of the pivotable pawl, so that the rocker lever generates a torque on the pivotable pawl that wants to pivot the pivotable pawl away from the rocker lever.

3. The electrical switch of claim 1, wherein the properties of the outer surface of the rocker lever are such that, when the pawl pivots away from the rocker lever, a positive fit or adhesion friction prevents the pivotable pawl sliding on the outer surface and a rotational movement of the rocker lever around the rotary bearing is instigated.

4. The electrical switch of claim 1, wherein the switch includes a tripping shaft which, in the locked state of the locking device, rests with a stop on the pawl and prevents the pawl from pivoting away from the rocker lever.

5. The electrical switch of claim 1, wherein a pin is attached to the rocker lever which is guided in a motion link of the tensioning lever, whereby the guide link limits the pivot angle of the rocker lever around the tensioning lever.

6. The electrical switch of claim 5, wherein the guide link is formed by a hole or a slot.

7. An electrical switch, comprising:

a tensioning lever, configured to assume, in a switched-on state of the electrical switch, a tensioning lever position tensioned by spring tension; and a locking device, configured to lock the tensioning lever in the tensioned tensioning lever position, the locking device including a rocker lever, attached rotatably to the tensioning lever around a rotary bearing, and a pawl, pivotable around a pivot point, configured to rest on the rocker lever and prevent the pivoting of the tensioning lever in the locked state and, configured to, after an unlocking of the locking device, pivot away from the rocker lever to turn the rocker lever around the rotary bearing;

wherein the switch includes a tripping shaft which, in the locked state of the locking device, rests with a stop on the pawl and prevents the pawl from pivoting away from the rocker lever; and wherein the locking device includes a spring which rests with one spring end on the tripping shaft and with another spring end on the pawl and generates a torque which is in opposition to the torque that the rocker lever exerts on the pawl.

8. The electrical switch as claimed in claim 7, wherein the spring force of the spring is dimensioned such that the torque exerted by the spring is less than the torque exerted by the rocker lever.

9. The electrical switch of claim 1, further comprising:

a switch lever, which makes it possible for an operator to switch the switch on and off, the switch lever being connected to the tensioning lever.

10. A locking device for an electrical switch to lock a tensioning lever of the electrical switch into a tensioned tensioning lever position, comprising:

a rocker lever, rotatably attachable to the tensioning lever around a rotary bearing; and a pawl, pivotable around a pivot point at an uppermost edge of the pawl and configured to rest on the rocker lever to prevent pivoting of the tensioning lever in a locked state, and configured to, after the unlocking of the locking device, pivot away from the rocker lever and to turn, or at least being capable of turning, the rocker lever around the rotary bearing.

11. A method for locking and unlocking a locking device of an electrical switch, comprising:

locking the locking device, using a pawl which is pivotable around a pivot point at an uppermost edge of the pawl into a position in which the pawl rests on a rocker lever, and being rotatable around a rotary bearing, attached to a tensioning lever, to prevent the pivoting of the tensioning lever; and unlocking the locking device, using the pivotable pawl to pivot away from the rocker lever wherein, during the pivoting away of the pivotable pawl, the pivotable pawl turns the rocker lever around the rotary bearing attached to the tensioning lever.

12. The electrical switch of claim 2, wherein the properties of the outer surface of the rocker lever are such that, when the pawl pivots away, a positive fit or adhesion friction prevents the pivotable pawl sliding on the outer surface and a rotational movement of the rocker lever around the rotary bearing is instigated.

13. The electrical switch of claim 2, wherein the switch includes a tripping shaft which, in the locked state of the locking device, rests with a stop on the pawl and prevents the pawl from pivoting away from the rocker lever.

14. The electrical switch of claim 2, wherein a pin is attached to the rocker lever which is guided in a motion link of the tensioning lever, whereby the guide link limits the pivot angle of the rocker lever around the tensioning lever.

* * * * *